US012571210B1

(12) United States Patent
Wong et al.

(10) Patent No.: US 12,571,210 B1
(45) Date of Patent: Mar. 10, 2026

(54) UTILITY ALIGNMENT AND CONNECTION SYSTEM FOR PREFABRICATED BUILDINGS

(71) Applicant: Cloud Apartments, Inc., Richmond, CA (US)

(72) Inventors: Curtis Harrison Wong, San Jose, CA (US); Matthew Christopher Rapa, Concord, CA (US); James Alexander Morris Tuchel, Los Angeles, CA (US)

(73) Assignee: Cloud Apartments, Inc., Richmond, CA (US)

( * ) Notice: Subject to any disclaimer, the term of this patent is extended or adjusted under 35 U.S.C. 154(b) by 0 days.

(21) Appl. No.: 19/048,680

(22) Filed: Feb. 7, 2025

Related U.S. Application Data

(60) Provisional application No. 63/552,038, filed on Feb. 9, 2024.

(51) Int. Cl.
*F16L 37/56* (2006.01)
*E04C 2/52* (2006.01)

(52) U.S. Cl.
CPC ..... *E04C 2/521* (2013.01)

(58) Field of Classification Search
CPC ..... E04C 2/521; E04C 2/526; F16L 37/02; F16L 37/56; F16L 37/58; F16L 37/62; F16L 39/00; F16L 39/06
See application file for complete search history.

(56) References Cited

U.S. PATENT DOCUMENTS 3,290,763 A * 12/1966 Zahuranec ..... F16L 39/00 29/237
4,694,859 A * 9/1987 Smith, III ..... F16L 1/26 285/11
5,148,929 A * 9/1992 Wernecke ..... F16L 37/002 212/180
5,316,347 A * 5/1994 Arosio ..... E02F 3/3654 285/85
5,342,098 A * 8/1994 Wilkins ..... F16L 37/56 285/309
5,464,042 A * 11/1995 Haunhorst ..... F24F 13/0209 137/614.04

(Continued)

FOREIGN PATENT DOCUMENTS

WO WO 2021/163804 A1 8/2021

*Primary Examiner* — Aaron M Dunwoody
(74) *Attorney, Agent, or Firm* — Fenwick & West LLP

(57) ABSTRACT

Disclosed is a connection system having a fixed plate assembly and a movable plate assembly. The fixed plate assembly includes a first base plate having a female alignment guide, a pressurized fixed plate coupler, and an unpressurized fixed plate coupler. The movable plate assembly has a second base plate with a male alignment pin, at a pressurized movable plate coupler, and an unpressurized movable plate coupler. The female alignment guide receives the male alignment pin to align the two assemblies. With alignment, the second base plate slides towards and couple with the first base plate so that the pressurized fixed plate coupler couples with the pressurized movable plate coupler and seals together through insertion of a fastener between them. Further, the unpressurized fixed plate coupler couples with the unpressurized movable plate coupler and seals together through insertion of a fastener between them.

10 Claims, 14 Drawing Sheets

(56) References Cited

U.S. PATENT DOCUMENTS 6,017,065 A * 1/2000 Hellesøe ..... F16L 1/26 285/25
6,302,147 B1 * 10/2001 Rose ..... F16L 37/56 137/614.04
6,595,552 B1 * 7/2003 Mortari ..... F16L 39/00 285/24
7,686,563 B2 * 3/2010 Frey ..... E02F 9/2267 37/468
8,864,179 B2 * 10/2014 Kitagawa ..... F16L 37/36 285/124.3
9,624,955 B2 * 4/2017 Lewkoski ..... E21B 33/0385
10,164,373 B1 * 12/2018 Cheon ..... H05K 7/20781
10,958,014 B1 * 3/2021 Martin ..... H01R 13/6215
11,041,584 B2 * 6/2021 Foner ..... F16L 37/16
11,079,053 B2 * 8/2021 Wolf ..... F16L 37/56
2006/0079107 A1 * 4/2006 Allensworth ..... H01R 13/6277 439/271
2006/0130910 A1 * 6/2006 Knuthson ..... F16L 37/56 137/614.02
2009/0051163 A1 * 2/2009 Frey ..... E02F 3/3627 285/305
2009/0078541 A1 * 3/2009 Foster ..... F16L 39/00 198/750.6
2009/0322072 A1 * 12/2009 Tiberghien ..... F16L 37/56 285/24
2010/0077593 A1 * 4/2010 Ceelen ..... F16L 39/00 439/378
2011/0198841 A1 * 8/2011 Kitagawa ..... F16L 37/32 285/314
2013/0309886 A1 * 11/2013 Tiberghien ..... H01R 12/91 439/695
2014/0112699 A1 * 4/2014 Lewkoski ..... F16L 39/04 403/33
2015/0308599 A1 * 10/2015 Mikulski ..... F16L 1/26 29/402.03
2018/0135785 A1 * 5/2018 Koller ..... F16L 37/56
2019/0154065 A1 * 5/2019 Tiberghien ..... H01R 25/006
2019/0237886 A1 * 8/2019 Eriksson ..... F16L 37/56
2019/0350118 A1 * 11/2019 Maro ..... A01B 59/042
2020/0300398 A1 * 9/2020 Le Polotec ..... F16L 39/00
2021/0394262 A1 * 12/2021 Tiberghien ..... F16L 39/00
2022/0196194 A1 * 6/2022 Lafond ..... H01R 13/62944
2023/0094260 A1 * 3/2023 Durieux ..... F16L 29/04 251/149.6
2023/0104556 A1 * 4/2023 Bowron ..... B66C 13/08 52/125.6
2023/0246367 A1 * 8/2023 Glössl ..... F16L 41/001 439/191
2024/0392905 A1 * 11/2024 Rusconi ..... H01R 13/5219
2025/0257833 A1 * 8/2025 Hagen ..... F16L 37/56

* cited by examiner

104

(a) Riser section view

105

(b) Alignment section view

105

UTILITY ALIGNMENT AND CONNECTION SYSTEM FOR PREFABRICATED BUILDINGS

CROSS REFERENCE TO RELATED APPLICATIONS

This application claims the benefit of, and priority to, U.S. Provisional Application No. 63/552,038, filed Feb. 9, 2024, which is incorporated by reference in its entirety.

TECHNICAL FIELD

The disclosure generally relates to connecting the utility systems of volumetric modules together, including mechanical, electrical and plumbing (MEP) systems, for example, of multi-story buildings.

BACKGROUND

Prefabricated construction is a process of construction where sections of a building are built in a factory and shipped to the construction site to be assembled. The intent of prefabrication is to save on the cost or time of construction by reducing the amount of labor required at a construction site. The prefabricated or factory-built sections can be in different forms such as wall and floor panels that are shipped flat-packed or with entire room units finished out that are shipped as volumetric modules. Volumetric modular is the more common form of prefabricated construction and, when used for commercial buildings, is often used to build multistory buildings such as apartments or hotels. Volumetric modular or modular, typically uses wood or steel as its primary structure and ships from the factory to the construction site with completed interiors. The cost and time savings of construction occur because site contractors have a large portion of the building completed after the modules are assembled, typically using a crane. The site contractor's scope becomes the conventional sitework such as grading, foundations and utilities, then modular scopes such as structural connections, utility hook-ups, and final finishes.

Time savings are expected within projects utilizing prefabricated construction. However, cost savings are often not realized. The problem is that site contractors have a difficult time pricing projects correctly because their reduced scopes of work are not immediately clear. Further, complexity arises in the field for site contractors determining how to assemble and install factory-built sections of a building that often do not fit together perfectly. The scope of work that best exemplifies this problem centers around the hook-up of mechanical, electrical, and plumbing (MEP) systems of modules. MEP systems consist of pipes, ducts, vents and electrical feeders that need to run vertically and horizontally throughout a building bringing power, internet, air, and water, while taking away waste. MEP scopes require specialized contractors and take up a substantial portion of any construction budget. Within modular construction, MEP is typically partially completed in the factory with reliance on specialized site contractors to complete the vertical and horizontal runs in the field. The result is that MEP budgets are insignificantly reduced and cost savings for prefabricated construction are not realized.

Prior attempts at solving the problem have included pre-installing vertical runs of pipes in the walls or shafts of modules and reducing the site contractor scopes to only connecting existing pipes, ducts and feeders. However, issues from this approach include pipes not aligning after modules are set by crane because of unaccounted for tolerance issues or because of miscommunication between factory and site contractors. The verdict within the industry is that pre-installing MEP vertical and horizontal runs is not worth the risk of misalignment or error because it is costly to tear out and replace this work, rather relying on the specialized site contractors for the bulk of MEP, even on modular projects, has become the standard.

SUMMARY

Disclosed is a system to reduce the scope of work required to connect (or hook-up) MEP systems of prefabricated buildings by allowing for the pre-installation of MEP vertical risers in the factory and a connection interface that can be done in the field rapidly and with unskilled labor.

In one embodiment, a MEP connection system assembles a series of alignment pins, telescoping pipes and connection plates so that multiple utility connections can be made by sliding a single moving plate into another fixed plate.

The disclosed MEP connection system beneficially creates an alignment system that minimizes tolerance at module set to ensure fit between plates, a movable plate that holds pressure at the full stroke of its movement, an interface between the movable and fixed plates that seals multiple connections when pressed together, a lock-out at each connection that can withstand forces when pipes are pressurized, and resiliency for the connections to be maintained throughout the lifespan of the building.

BRIEF DESCRIPTION OF THE DRAWINGS

The disclosed embodiments have other advantages and features which will be more readily apparent from the detailed description, the appended claims, and the accompanying figures (or drawings). A brief introduction of the figures is below.

DETAILED DESCRIPTION

Figure 1A:
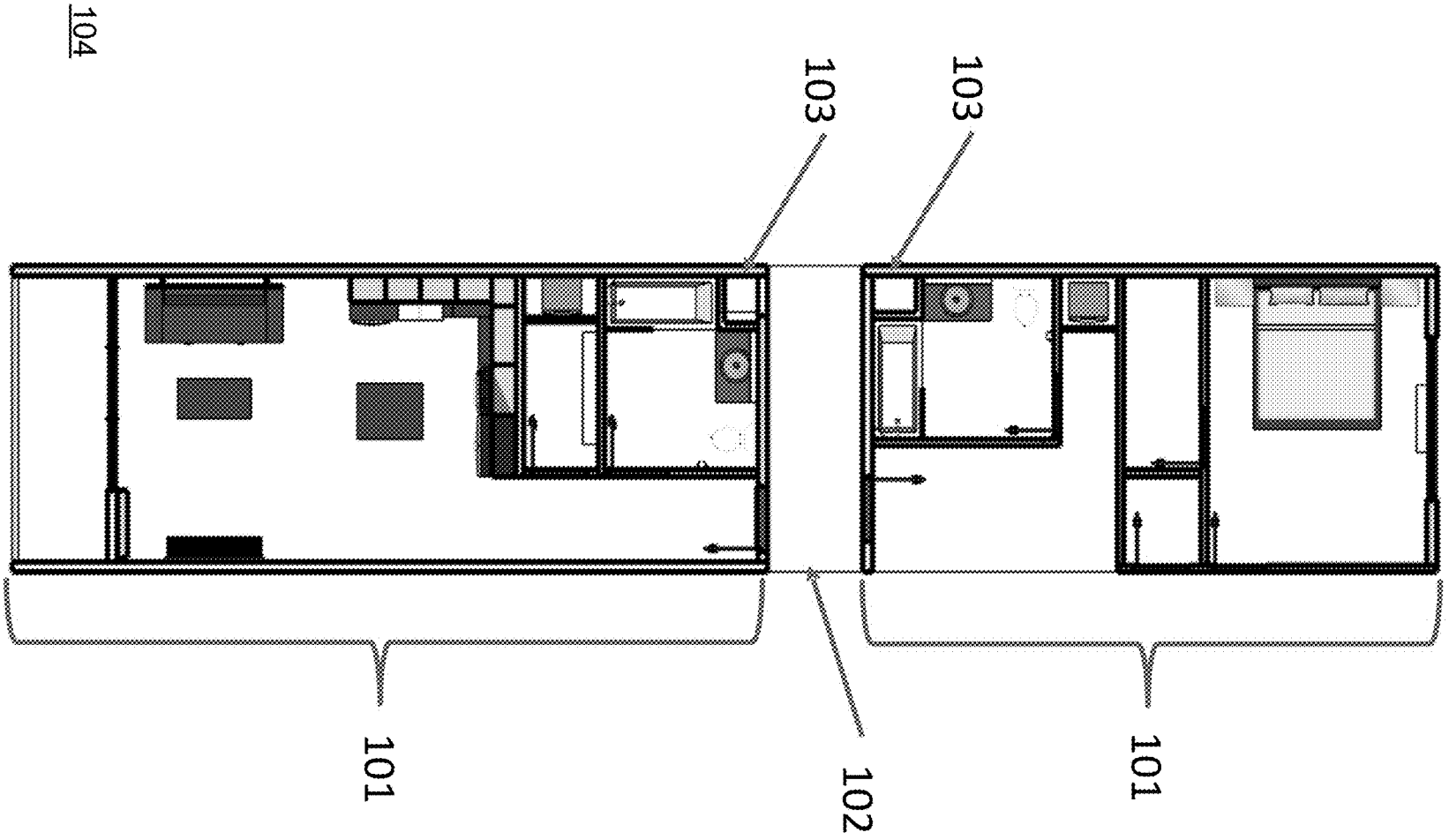
FIG. 1A illustrates an example of a modular floor plan in accordance with an embodiment.

Each Figure (FIG.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

For ease of discussion and understanding, it is noted that as used herein a "module" is a manufactured volumetric space, consisting of a room unit that may or may not have a bedroom, living room, bathroom or kitchen. It may also have an unoccupiable space meant for public use such as a corridor or common area. A "riser" is a utility line such as a pipe or wire for plumbing or electrical that runs vertically from module to module, typically within a shaft. A "MEP" is a mechanical system, an electrical system, and/or a plumbing system that make up the utility systems throughout the building.

Continuing, a "mateline" are points where discrete modules connect to each other and can be horizontal or vertical. A "shaft" is an empty space within a module that allows risers to run vertically between stacked modules. An "offsite" is a factory where the module is manufactured. An "onsite" is a jobsite or construction site where the module will be set into its final permanent position. "Pre-installed" or "pre-installation" is installation within a module in a factory before it is brought onsite. "Stacking" includes an act of placing modules on top of or next to each other by a crane at the construction site. A "riser connection system" are features that align and connect the risers within the shaft of a module to another module above or below.

Various embodiments as disclosed herein improve utility connections due to the improved alignment of the corridor walls and shafts where the utility risers and runs typically live. This means that the onsite scope for utilities reduces from installing the entire systems onsite to connecting pre-installed risers together. Furthermore, the invention allows the onsite utility connections to be done by unskilled labor when this is typically done by only skilled tradesmen such as plumbers and electricians.

Various embodiments of the disclosed configuration reduce interior finish work because, when the risers can be pre-installed due to the improved alignment between modules, interior finishes can be moved into the factory as well. In today's form of modular construction, the entire corridor interiors are left unfinished with the sheetrock left for onsite installation of mechanical, electrical and plumbing (MEP) systems. In some embodiments, corridors are finished with sheetrock in the factory except for locations near the matelines or at shafts, reducing the onsite scope to patching interior matelines and shaft walls.

Figure (FIG. 1A is a floor plan of an exemplary module 104 comprising occupiable room areas 101, a corridor 102, and a shaft 103. In this example module 104 there are two occupiable room areas 101 connected with a corridor 102. In some configurations there may be a single occupiable room area 101. The occupiable room area 101 may comprise a bathroom, kitchen, living room or bedroom that is occupiable by a tenant. The shaft 103 is a vertical space that spans between modules and is where utility risers are located to connect plumbing, electrical, and HVAC systems. The corridor 102 is where utility runs live within the ceiling and where people travel throughout the building. The module 104 may be manufactured in an offsite factory and transported to the construction site by a vehicle (e.g., a truck or ship) or may be manufactured at one part of a site and moved to another part of the construction site. Once manufactured and transported to where the building will be erected it may be erected (or set up) using an assembly mechanism, e.g., a crane or other lift.

Figure 1B:
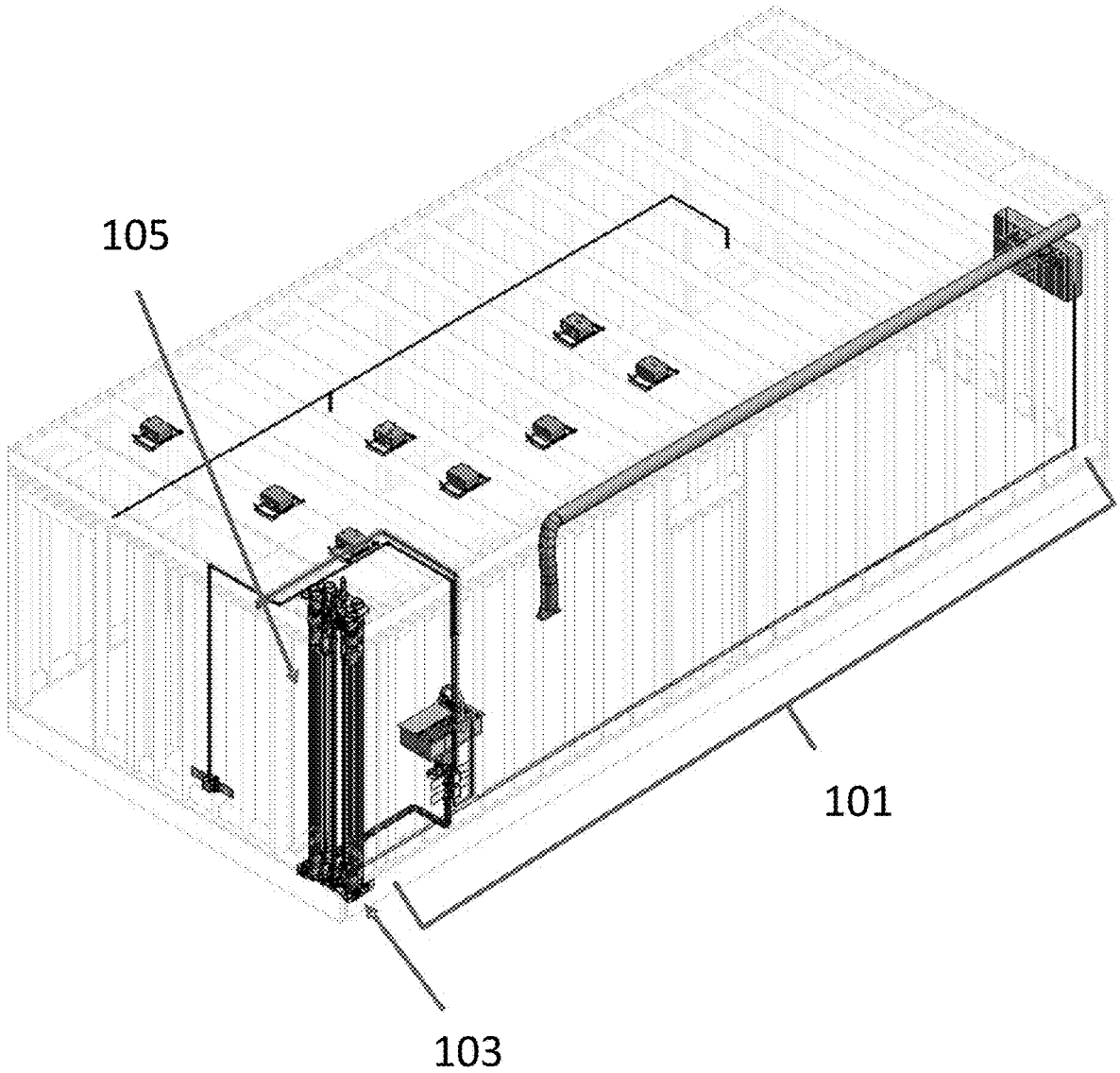
FIG. 1B: illustrates an example of a module with the riser connection system in accordance with an embodiment.

FIG. 1B an isometric view of the module 104 in a single-loaded condition with one occupiable room area 101 with the corridor 102 not shown. In a corner of this view of the module 104 is a shaft 103. The riser connection system 105 is shown within the shaft 103.

Figure 1C:
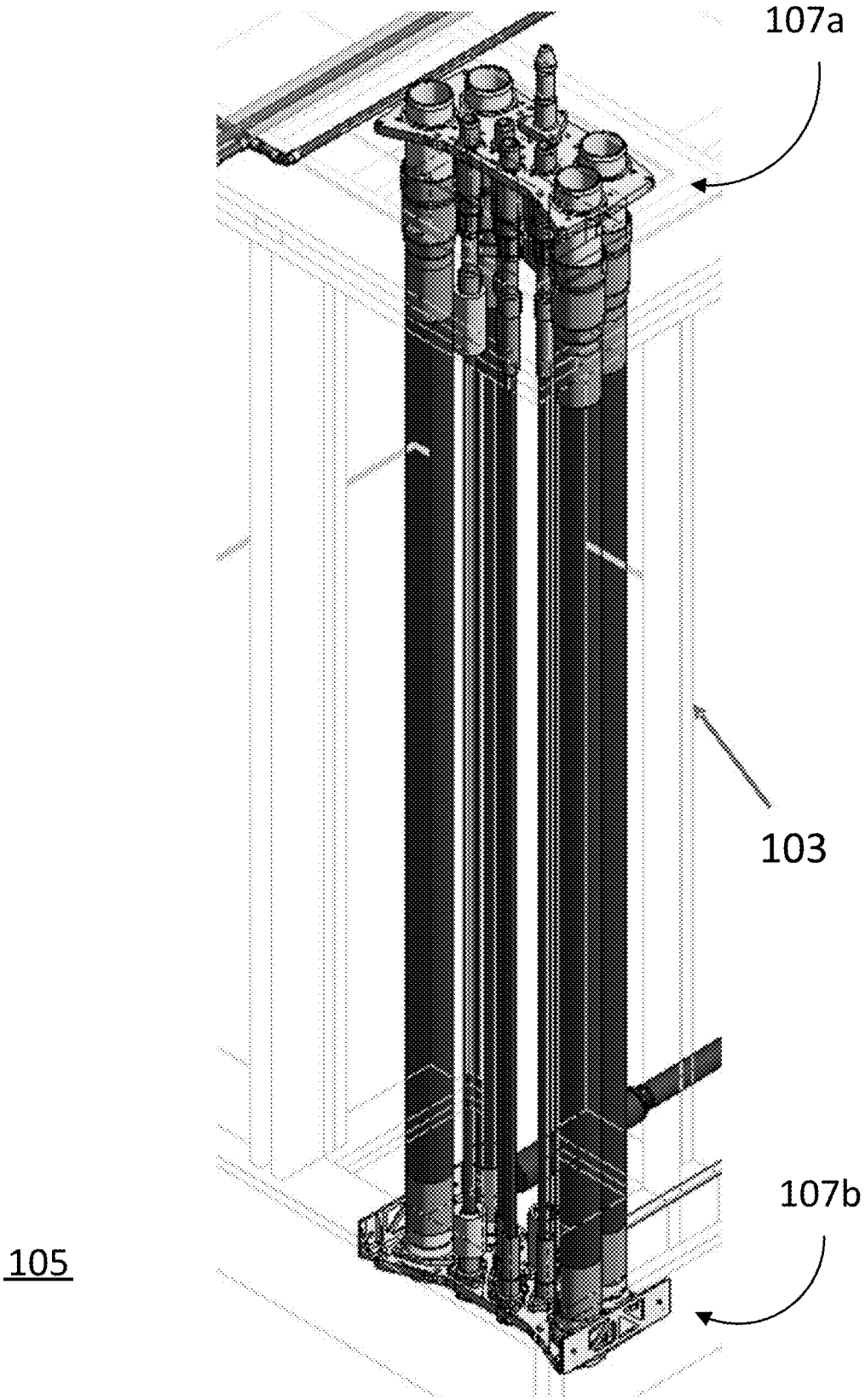
FIG. 1C illustrates an example of a modular with the riser connection system in accordance with an embodiment.

FIG. 1C shows a closer view of the riser connection system 105 within the shaft 103. More specifically, in this view, one or more of risers comprise the riser connection system 105. Each riser connection system 105 includes a bottom interface 107*a* that is structured along a bottom portion of the riser connection system 105. Each riser connection system 105 also includes a top interface 107*b* that is structured along a bottom portion of the riser connection system 105.

Figure 1D:
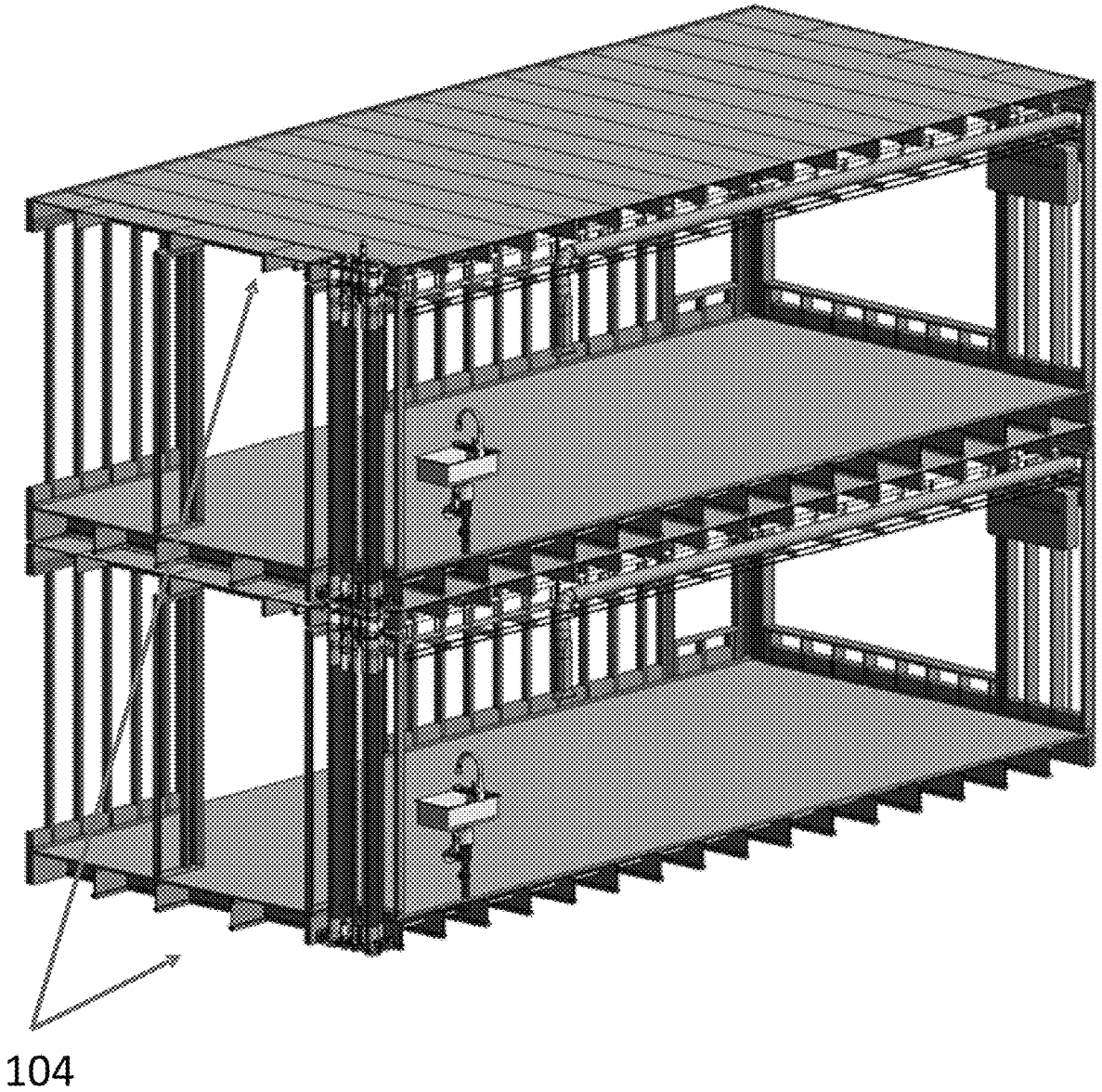
FIG. 1D illustrates an example of multiple modules each with riser connection systems in accordance with an embodiment.

FIG. 1D is an isometric view of multiple modules 104 stacked on top of each other, each with riser connection systems 105 that are used by MEP systems, e.g., power, internet, waste, and water to occupiable room areas 101 throughout the building. In this example, the modules 104 are aligned such that the shaft 103 of each are collocated in a same position relative to each other. For example, if a module 104 has a shaft 103 is in front left corner 109, the modules 104 are stacked so that all the shafts 103 are aligned along the front left corner.

Figure 1E:
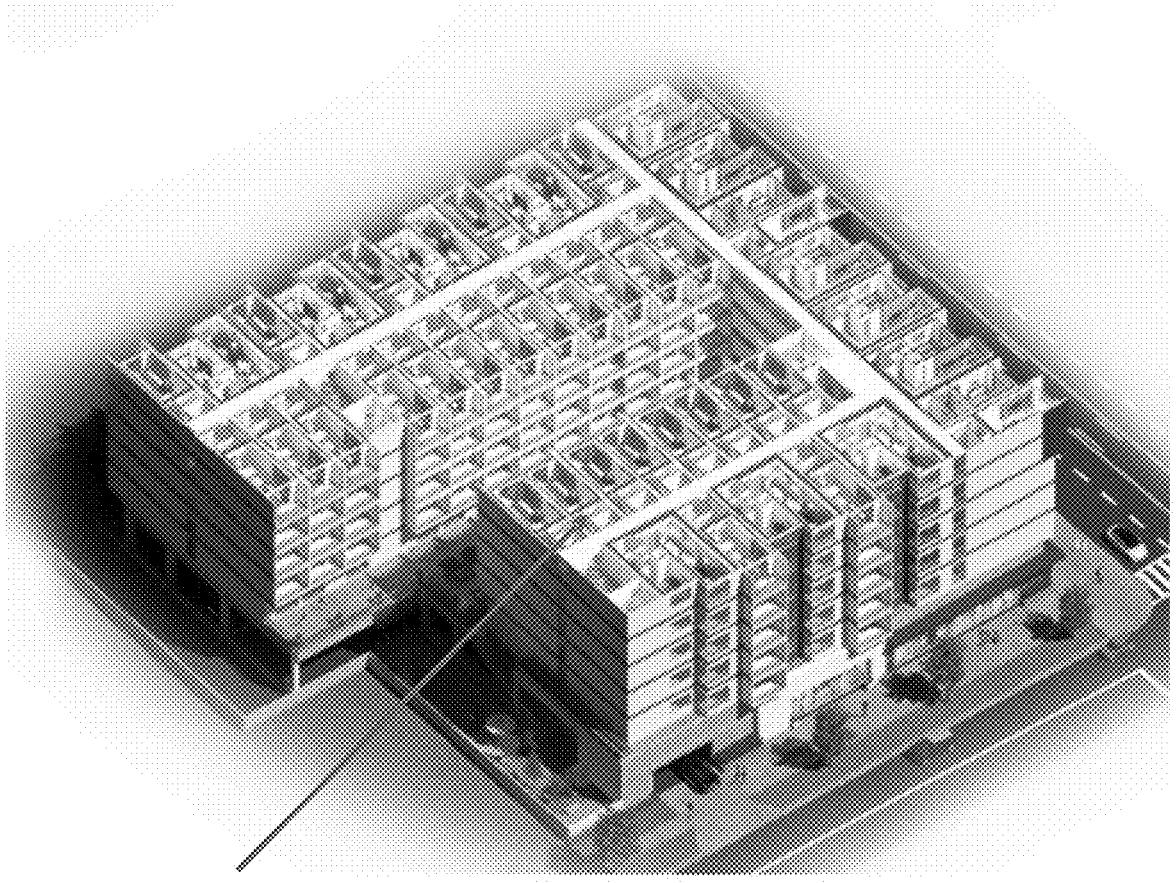
FIG. 1E illustrates an example of a building made of multiple modules in accordance with an embodiment.

FIG. 1E is an example view of a modular building 106 comprising many modules connected together to form an erected building complex. In this configuration, the modules 104 that make up the complex are stacked beginning with a ground level in a way that a shaft 103 of each vertically stacked module 104 is aligned with a shaft 103 of a module 104 placed just above it.

Figure 2:
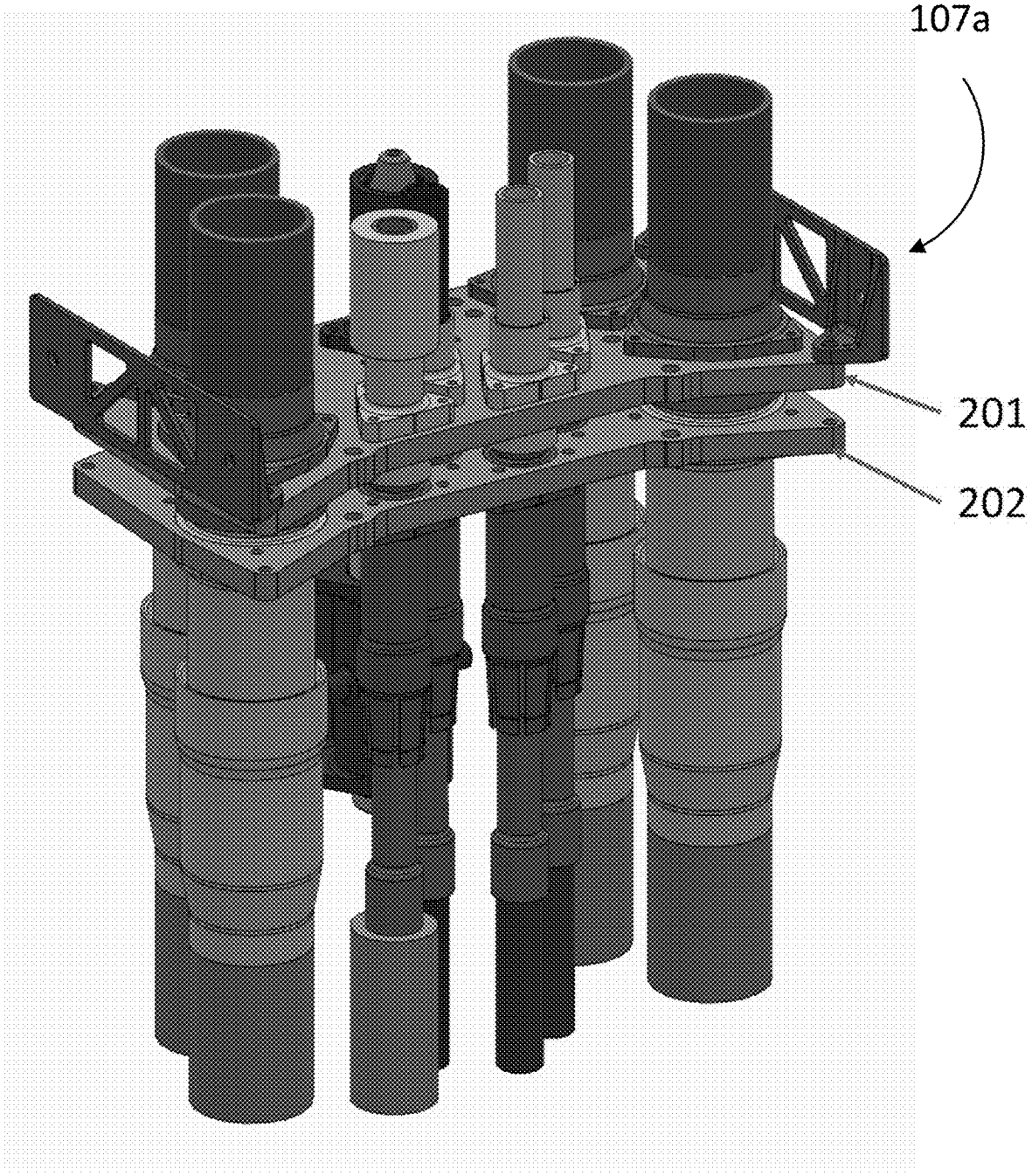
FIG. 2 illustrates an example of a riser connection system assembly in accordance with an embodiment.

FIG. 2 is a close-up view of an example of the bottom interface 107*a* of the riser connection system 105 in accordance with an embodiment. The bottom interface 107*a* includes a fixed plate assembly 201. A bottom interface 107*a* of a second riser connection system that is above a first riser connection system will couple with a movable plate assembly 202 that is a top interface 107*b* of first riser. The fixed plate assembly 201 and a movable plate assembly 202 form a coupling structure for a MEP utility connection between two riser connection systems. The utility connection is made when the fixed plate assembly 201 and the movable plate assembly 202 are coupled, e.g., pressed, together. The fixed plate assembly 201 and the movable plate assembly 202 are further described below.

Figure 3:
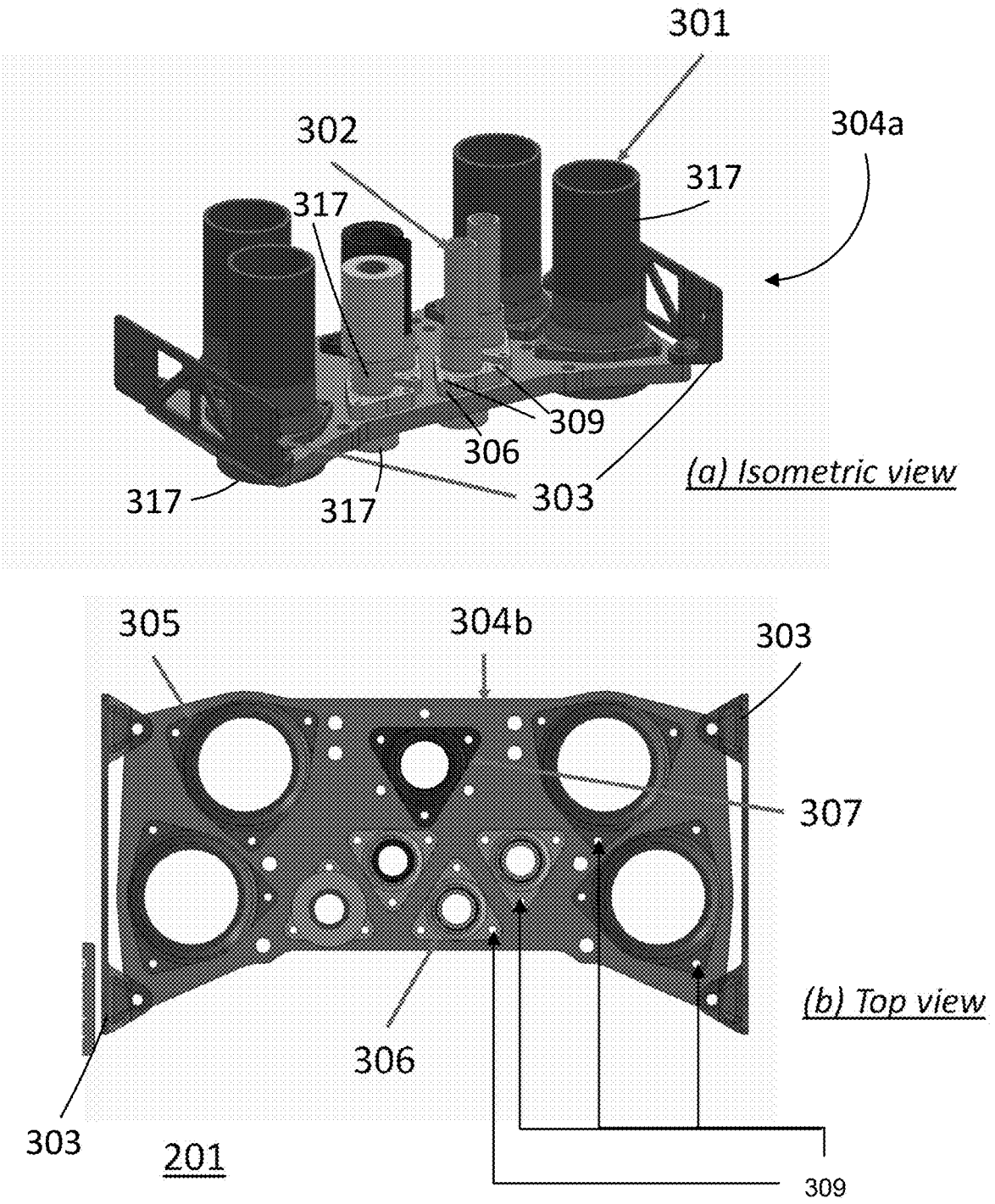
FIG. 3 illustrates an example of a fixed plate assembly in accordance with an embodiment.

FIG. 3 illustrates an example of the fixed plate assembly 201 of the bottom interface 107*a* in accordance with an embodiment. The fixed plate assembly 201 in a first view with a first base plate 304*a* having pipes, e.g., 301, 302, to be coupled (a) and a second view showing a top view 304*b* showing openings for the pipes, e.g., 301, 302, (b), both shown for clarity. The fixed plate assembly 201 includes a first fixed plate bracket and a second fixed plate bracket (generally 303). The movable plate assembly 202 of a first riser connection system is configured to couple with the fixed plate assembly 201 of a second riser connection system as further illustrated and described with FIGS. 3-5. Accordingly, the assemblies 201, 202 allow for quick and efficient MEP utility connections.

Turning to the isometric view (a) of the fixed plate assembly 201, it illustrates the base plate 304*a* with pipes 301, 302. The pipes 301, 302 pass through or are integrated with a fixed plate alignment coupler 305, 306 having one or more fastening holes 309. A coupler may be referenced as a connector fitting or a connection fitting. The fixed plate assembly 201 also includes a female alignment guide 307. In one embodiment, a fixed plate alignment coupler may be unpressurized, e.g., 305, or pressurized, e.g., 306. The alignment coupler 313 may include a protruding member 317 along a top and a bottom of the coupler 313. The protruding member 317 may be for a pipe 301, 302 to pass through or go over.

The base plate 304*a* of the fixed plate assembly 201 of the bottom interface 107*a* may have the one or more pipes separate from or integrated with one or more fixed plate alignment couplers 305, 306. One set of pipes are unpressurized pipes, e.g., 301, and pressurized pipes, e.g., 302, for the fixed plate assembly 201. The unpressurized pipes 301 are typically made of a rigid material, for example, cast iron or plastic. The unpressurized pipes, e.g., 301, may be used to transport liquids and solids vertically through a building with gravity alone. The unpressurized pipes, e.g., 301, also may be for vents for air. The pressurized pipes, e.g., 302, are pipes that are constructed of, for example, plastic, copper, cast iron, or steel, and may transport liquids such as refrigerant, cold water, hot water, or grey water or gases such as natural gas through a building.

Figure 4:
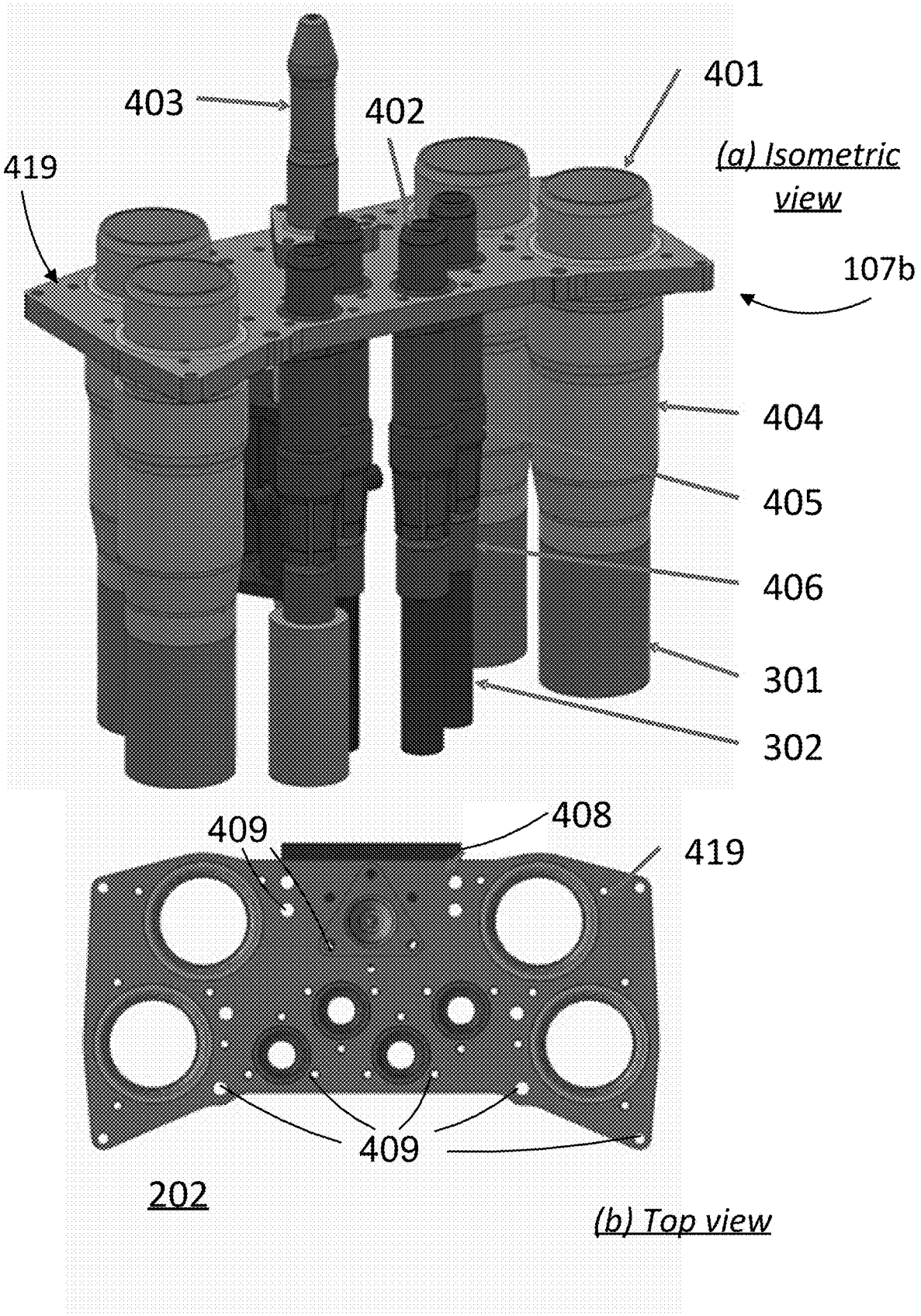
FIG. 4 illustrates an example of a movable plate assembly in accordance with an embodiment.

Turning to the top view 304*b* (b), the fixed plate alignment couplers, e.g., 305, 306, are structured to receive, align, and couple the unpressurized pipes, e.g., 301, and pressurized pipes, e.g., 302, via respective protruding member, to the movable plate assembly 202, which is illustrated and described with FIG. 4. The fixed plate brackets 303 may connect the fixed plate assembly 201 to the shaft 103. The fixed plate assembly 201 is assembled with the base plate 304*a*. The fixed plate assembly 201 may further couple with movable plate assembly 202 via the fastening holes 309 to further lock the components together as described also with FIG. 4.

FIG. 4 illustrates an example of the movable plate assembly 201 of the top interface 107*a* in accordance with an embodiment. The movable plate assembly 202 is illustrated in an isometric view (a) and a top view (b), both shown for clarity. As will be further described the moveable plate assembly 202 of the top interface 107*b* of a first riser connection system couples with the fixed plate assembly 201 of the bottom interface 107*a* of a second riser connection system.

The movable plate assembly 202 includes a second base plate 419 (i.e., this base plate 419 is separate from the first base plate 304*a*) having a male alignment pin 403 and one or more movable plate alignment couplers, e.g., 406, 408. The male alignment pin 403 is used to align the first riser connection system with the second riser connection system through the female alignment guide 307 of the bottom interface 107*a* of the second riser connection system.

The one or more movable plate alignment couplers may include an unpressurized movable plate alignment coupler 401, a pressurized movable plate alignment coupler 402, an unpressurized telescoping coupler 404, a pressurized telescoping coupler 406, and a sliding bracket 408. The movable plate alignment coupler 401 (e.g., a male member) acts as the interface for the unpressurized pipe-to-pipe connection by sliding within the unpressurized fixed plate alignment coupler 305 to seal them together. The pressurized movable plate alignment coupler 402 acts as the interface for the pressurized pipe-to-pipe connection by sliding within the pressurized fixed plate alignment coupler 306 to seal them together.

The unpressurized telescoping coupler 404 slides over the unpressurized movable plate alignment coupler 401 when the plate 419 is moved vertically. Similarly, the pressurized telescoping coupler 406 slides within the pressurized coupler 405 when the base plate 419 is moved vertically. The sliding bracket 408 connects the base plate 419 to the shaft 103 through, for example, a rail system, allowing vertical movement.

As noted with FIG. 3, the movable plate assembly 202 may be further coupled with the fixed plate assembly 201 through their respective fastening holes 309, 409 to further lock the components together. Fasteners to use with the fastening holes 409 may be, for example, a threaded nut and reciprocal threaded bolt, a clip, or a rivet. The fastening holes 309 of the fixed plate assembly 201 may be complementary to the fastening holes 409 of the movable plate assembly 202 and may be aligned to pass a fastener through both holes to secure the fixed plate assembly 201 with the movable plate assembly 202. Fasteners that may be used to couple the fixed plate assembly 201 with the moveable plate assembly 202 through the respective fastening holes 309, 409 may include, for example, a threaded nut and reciprocal threaded bolt, a clip, or a rivet.

Figure 5A:
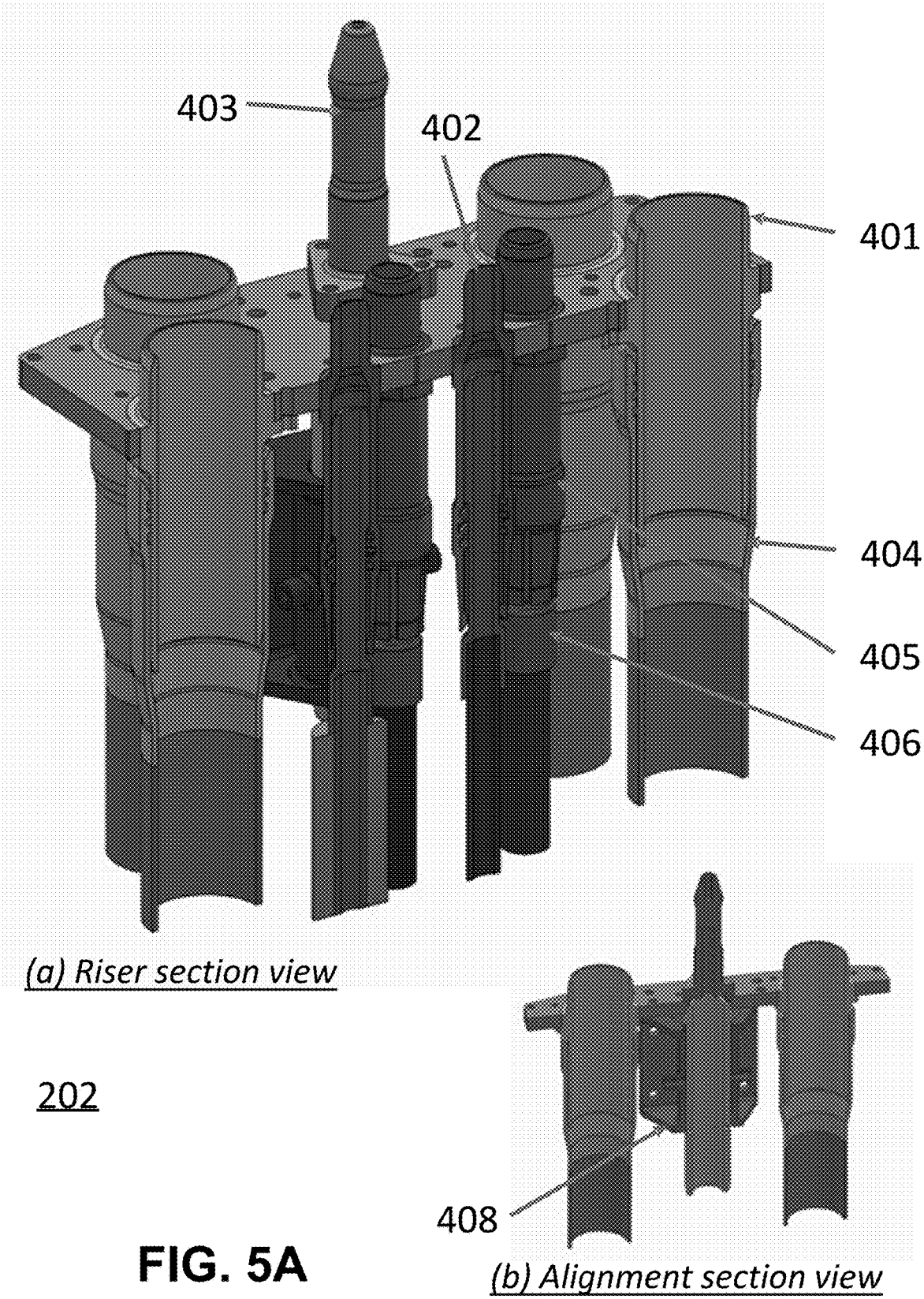
FIG. 5A through 5F illustrate an example sequence of connecting the riser connection system in accordance with an embodiment.

FIGS. 5A-5F illustrate the connection process. The process described is to connect the top interface 107*a* of a first riser connection system with the bottom interface 107*b* of a second riser connection system that would be immediately above the first riser connection system. Turning first to FIG. 5A, it shows a riser section view (a) and an alignment section view (b) during the start of the connection sequence with the movable plate assembly 202 in its lowered position. This is the state when the riser connection system 105 is pre-installed in the shaft 103 in the modular factory or when the module 104 first arrives at the construction site. In this position the sliding bracket 408 is set in the lower position, causing the alignment pin 403 to be lowered as well.

Figure 5B:
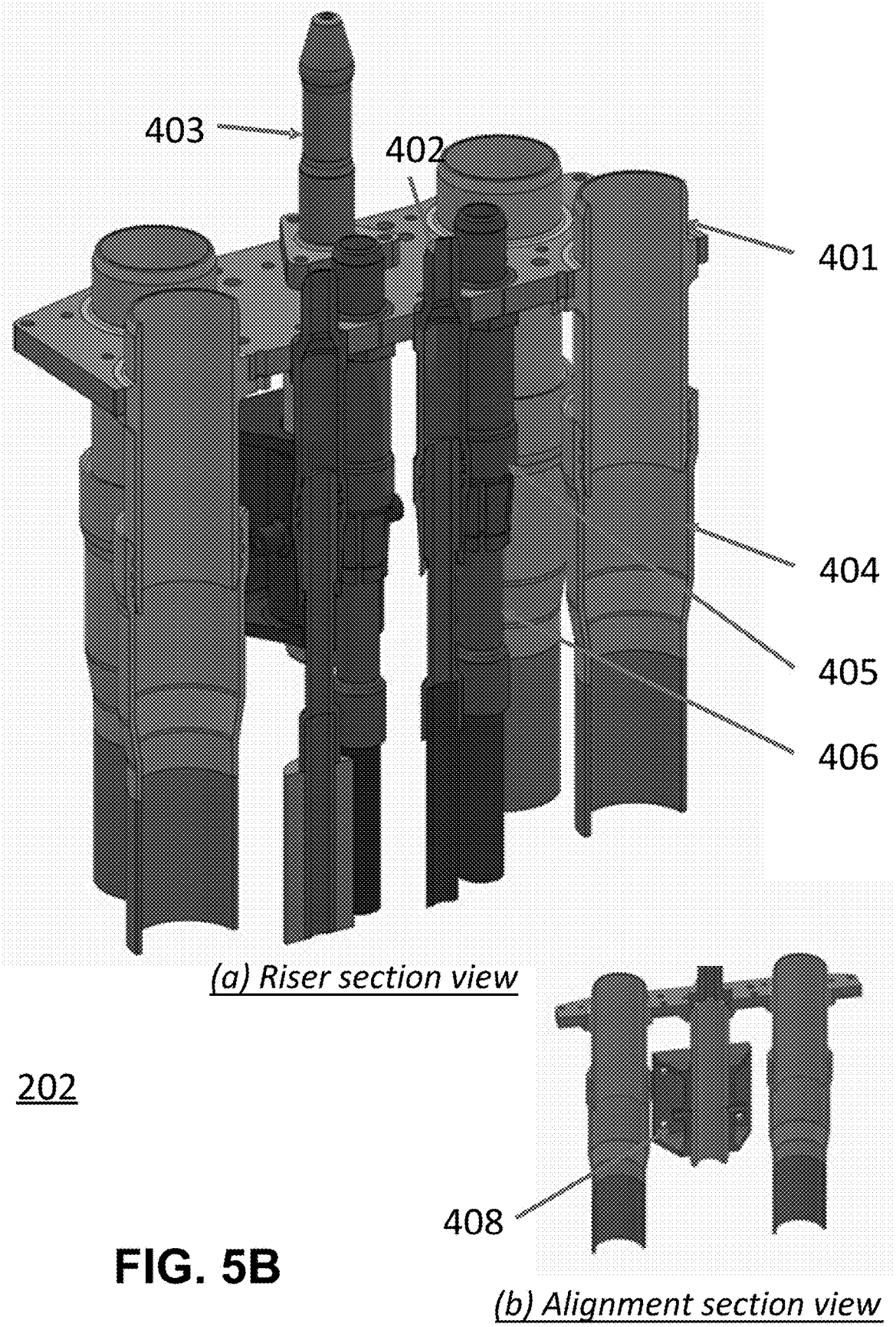

FIG. 5B shows a riser section view (a) and an alignment section view (b) as the movable plate assembly 202 is moved to its raised position. When the base plate 419 is raised by hand, hoist or screw, both the unpressurized movable plate alignment coupler 401 (e.g., a male fitting) and pressurized movable plate alignment coupler 402 (e.g., male fitting) moves upwards as well. The pipe-to-pipe seal is maintained during the stroke of this movement when the unpressurized telescoping coupler 404 and the pressurized telescoping coupler 406 allow relative vertical movement with a low-friction gasket. The pressurized male coupler 402 has a lock-out mechanism to prevent the pressurized telescoping coupler 406 from sliding back out from pressure force when the pressurized pipes 302 are pressurized. The telescoping coupler 406 may be structured to enable customized coupling where distance between the bottom interface 107*a* of one riser from the top interface 107*b* of another riser may not be standardized. Further, any of the fittings may be structured to be telescoping. The sliding bracket 408 may have a lock-out mechanism that prevents the movable plate 407 from sliding back downwards and further tightly couples the base plates 304, 419. In this position, the alignment pin 403 is raised as well.

Figure 5C:
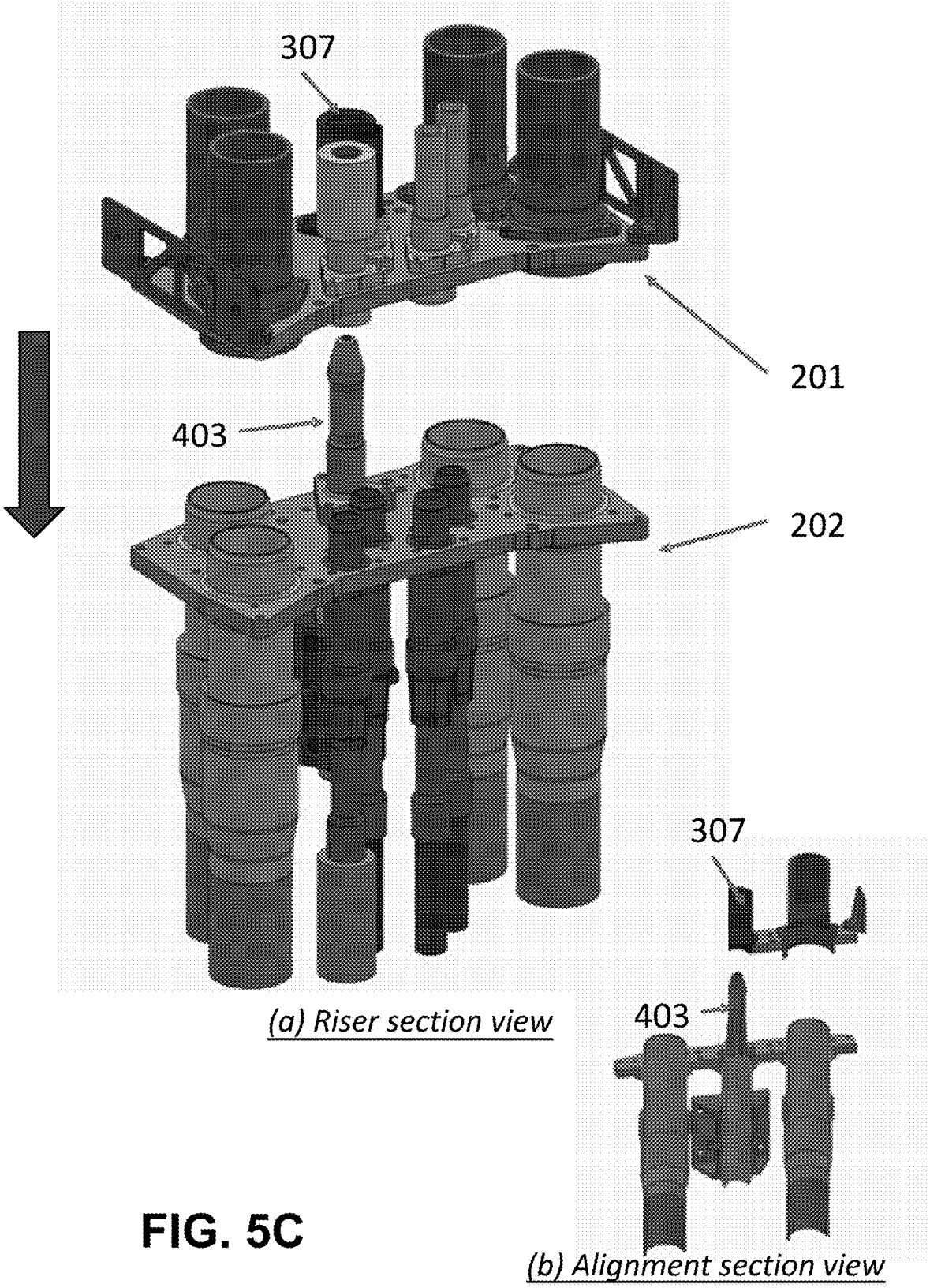

FIG. 5C shows a riser section view (a) and an alignment section view (b) during the fixed plate assembly 201 being set onto the movable plate assembly 202 in its raised position. This occurs when a module 104 is being set by crane on to another module 104. The movable plate assembly 202 can be in a raised or lowered position depending on whether the connection is made using the weight of the module 104 when it is lowered or after crane set using an external force to make the plate-to-plate connection.

Figure 5D:
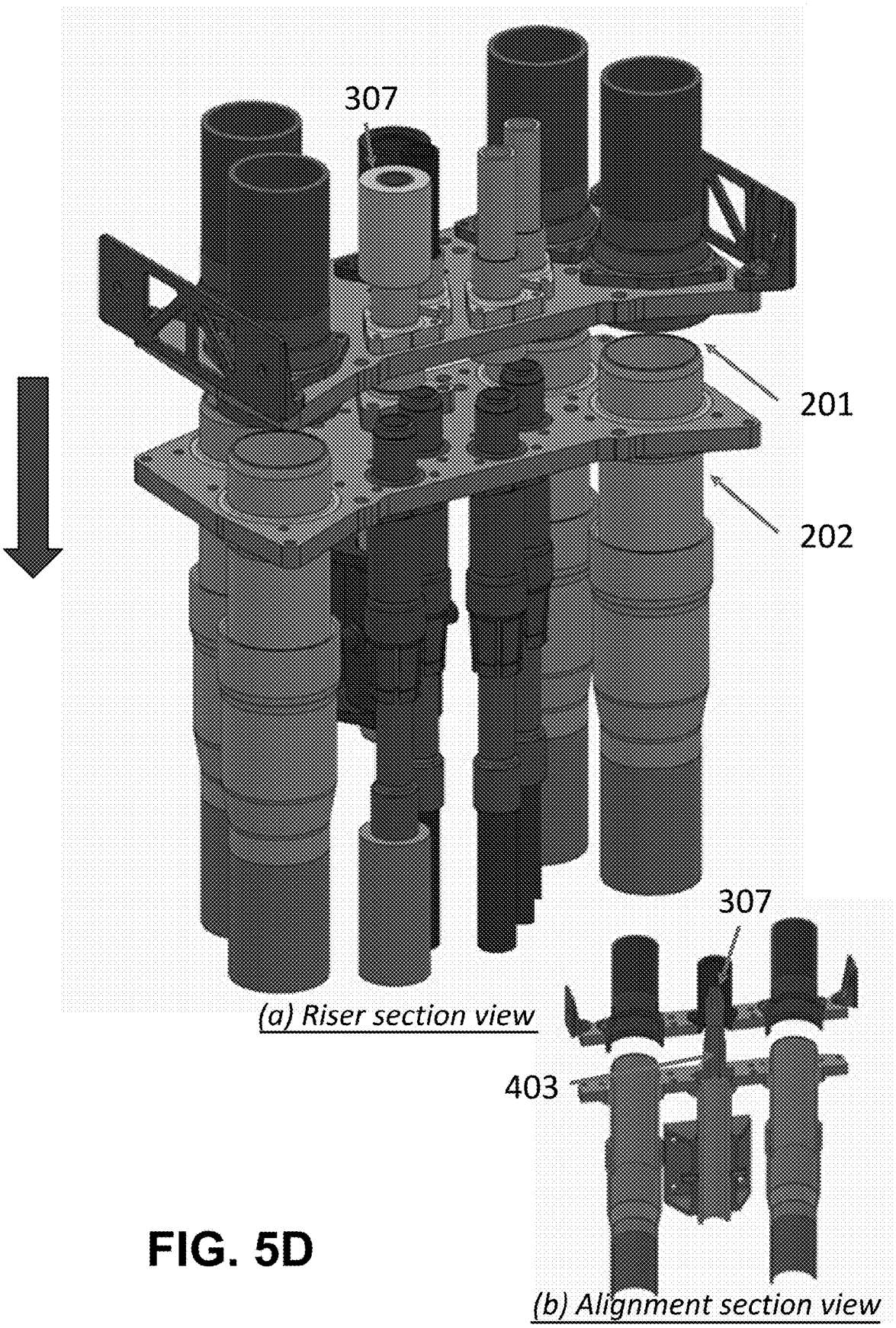

FIG. 5D shows a riser section view (a) and an alignment section view (b) during the fixed plate assembly 201 being lowered further on to the movable plate assembly 202. The male alignment pin 403 is aligned to pair with the female alignment guide 307.

Figure 5E:
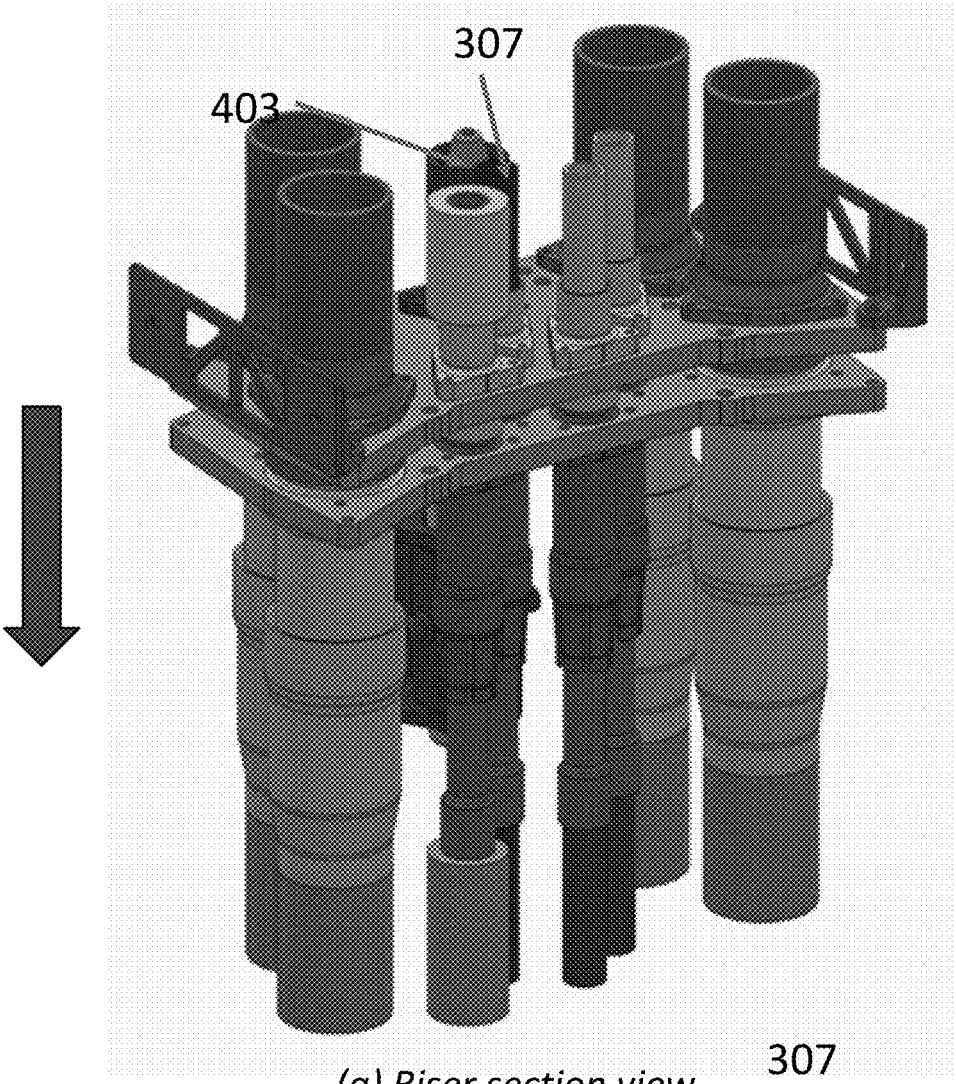
Figure 5E:
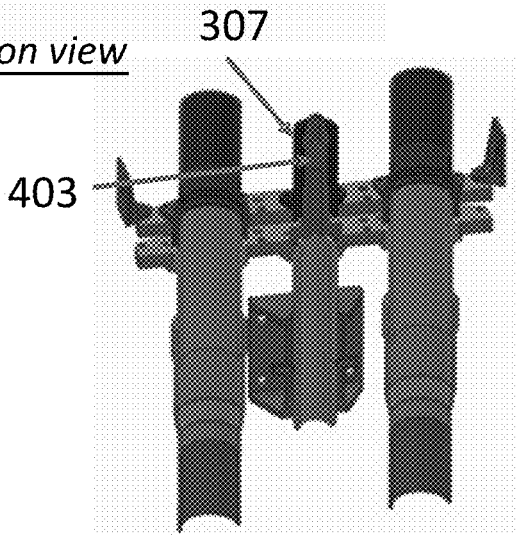

FIG. 5E a riser section view (a) and an alignment section view (b) during shows the fixed plate assembly 201 fully lowered on to the movable plate assembly 202. The male alignment pin 403 has a profile that allows the crane operator to set the module 104 with a high amount of tolerance with increasing accuracy as the module 104 is lowered.

Figure 5F:
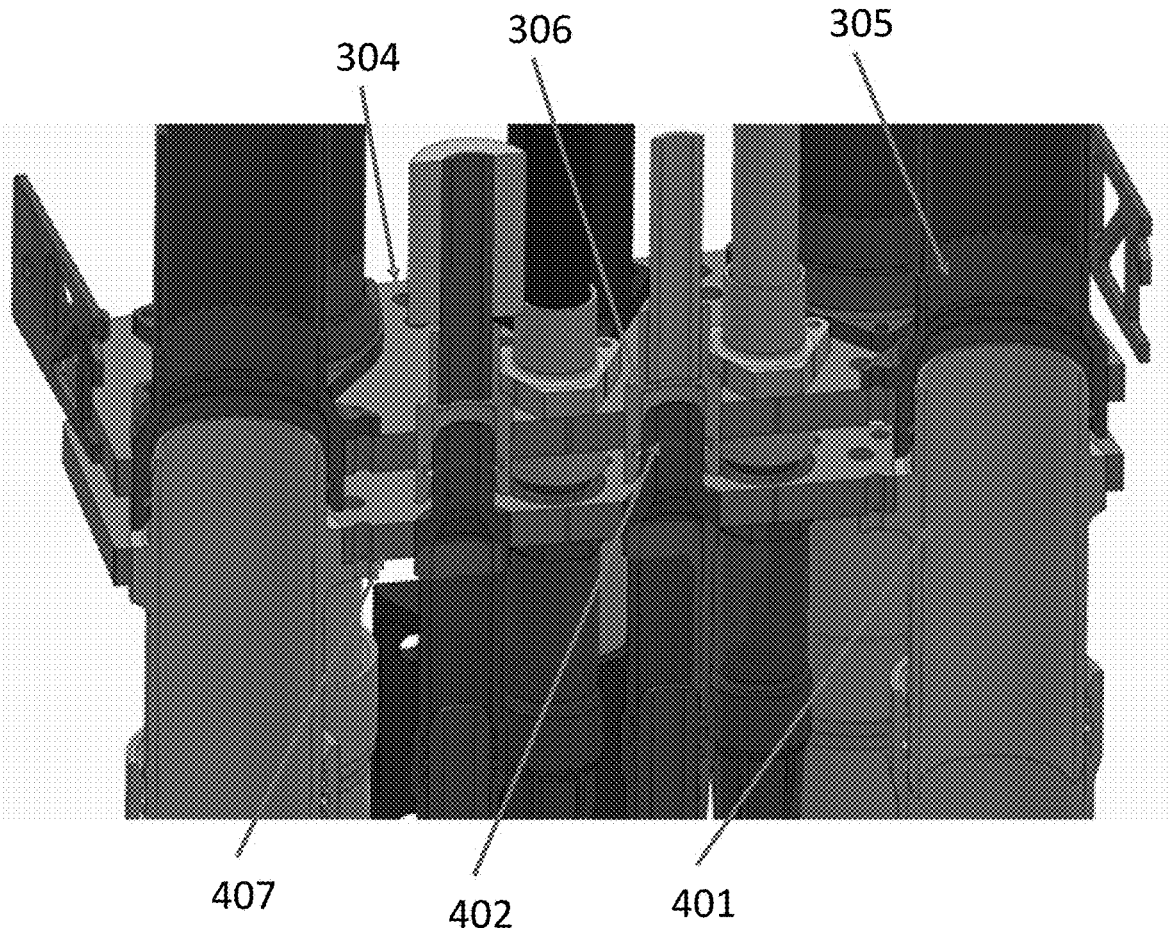

FIG. 5F shows a section view of the interface between both the unpressurized fixed plate alignment coupler 305 (e.g., female coupler) with the unpressurized movable plate alignment coupler 401 (e.g., male coupler) and the pressurized fixed plate alignment coupler 306 (e.g., female coupler) with the pressurized movable plate alignment coupler 402 (e.g., male coupler). The male alignment pin 403 profile aligns the fittings closely and the tapers on each of the fittings prevents binding. Low-friction gaskets within both the unpressurized fixed plate alignment coupler 305 (e.g., a female coupler) and the pressurized fixed plate alignment coupler 306 (e.g., a female connector) coupling with its reciprocal movable plate alignment coupler creates a seal that is resilient when the lock-out mechanism in the sliding bracket 408 is activated and can be taken apart for maintenance during the lifetime of the modular building 106. The interface is designed so that the seal of both the pressurized and unpressurized fittings are formed with an audible click and/or a visual cue when fixed plate 304 and movable plate 407 are pressed together planarly and within a fixed distance.

ADDITIONAL CONFIGURATION CONSIDERATIONS

The disclosed configuration beneficially aligns two or more large volume building modules to align and couple MEP systems without having to individually assemble each through each module. This configuration saves time and money in assembly larger sets of modules together vertically and enables fast assembly of building complexes.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Upon reading this disclosure, those of skill in the art will appreciate still additional alternative structural and functional designs for a system and a process for a utility alignment and connection system for modular building construction modules through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A connector system comprising:

a fixed plate assembly comprising a first base plate having a female alignment guide, at least one pressurized fixed plate coupler, and at least one unpressurized fixed plate coupler, each fixed plate coupler including a fastening hole; and a movable plate assembly comprising a second base plate having a male alignment pin, at least one pressurized movable plate coupler, and at least one unpressurized movable plate coupler, each movable plate coupler including a fastening hole, the female alignment guide structured to receive the male alignment pin, to align the fixed plate assembly with the movable plate assembly, the second base plate structured to slide towards and couple with the first base plate so that the at least one pressurized fixed plate coupler couples with the at least one pressurized movable plate coupler and seals together through insertion of a fastener between the fastening hole of the at least one pressurized fixed plate coupler and the fastening hole of the at least one pressurized movable plate coupler, and the at least one unpressurized fixed plate coupler couples with the at least one unpressurized movable plate coupler and seal together through insertion of a fastener between the fastening hole of the at least one unpressurized fixed plate coupler and the fastening hole of the at least one unpressurized movable plate coupler.

2. The connector system of claim 1, wherein a pressurized movable plate coupler of the at least one pressurized movable plate coupler is a pressurized telescoping coupler.

3. The connector system of claim 2, wherein an unpressurized movable plate coupler of the at least one unpressurized movable plate coupler is an unpressurized telescoping coupler.

4. The connector system of claim 3 wherein the movable plate assembly further comprises a bracket, the bracket structured to lock the movable plate assembly with the fixed plate assembly.

5. The connector system of claim 4, wherein the bracket is a sliding bracket.

6. The connector system of claim 1, wherein the fastener is a nut and bolt fastener.

7. The connector system of claim 6, wherein the at least one pressurized fixed plate coupler and the at least one pressurized movable plate coupler comprises one of copper, steel, plastic, and cast iron.

8. The connector system of claim 6, wherein the at least one unpressurized fixed plate coupler and the at least one unpressurized movable plate coupler comprises one of plastic and cast iron.

9. The connector system of claim 8, wherein at least one of the first base plate and the second base plate comprises a steel.

10. The connector system of claim 8, wherein at least one of the first base plate and the second base plate comprises a plastic.

* * * * *